US009217306B2

(12) United States Patent
Wilson

(10) Patent No.: US 9,217,306 B2
(45) Date of Patent: Dec. 22, 2015

(54) METHODS AND APPARATUS FOR CORING

(75) Inventor: Bob Talma Wilson, Litchfield Park, AZ (US)

(73) Assignee: NATIONAL OILWELL VARCO L.P., Houston, TX (US)

( * ) Notice: Subject to any disclaimer, the term of this patent is extended or adjusted under 35 U.S.C. 154(b) by 214 days.

(21) Appl. No.: 13/474,057

(22) Filed: May 17, 2012

(65) Prior Publication Data

US 2013/0081878 A1 Apr. 4, 2013

Related U.S. Application Data

(60) Provisional application No. 61/542,384, filed on Oct. 3, 2011.

(51) Int. Cl.
*E21B 25/06* (2006.01)

(52) U.S. Cl.
CPC ..... *E21B 25/06* (2013.01)

(58) Field of Classification Search
CPC ..... E21B 25/06; E21B 25/10
USPC ..... 175/244, 249
See application file for complete search history.

(56) References Cited

U.S. PATENT DOCUMENTS

| | | | | | |
|---|---|---|---|---|---|
| 2,893,691 | A | * | 7/1959 | Johnson | 175/226 |
| 2,927,775 | A | * | 3/1960 | Hildebrandt | 175/226 |
| 3,349,857 | A | * | 10/1967 | Hildebrandt | 175/250 |
| 3,383,131 | A | * | 5/1968 | Rosfelder | 294/68.21 |
| 3,621,924 | A | * | 11/1971 | Lebourg | 175/58 |
| 3,804,184 | A | * | 4/1974 | Gusman et al. | 175/226 |
| 4,479,557 | A | | 10/1984 | Park et al. | |
| 4,502,553 | A | | 3/1985 | Park et al. | |
| 4,512,419 | A | * | 4/1985 | Rowley et al. | 175/58 |
| 4,512,423 | A | * | 4/1985 | Aumann et al. | 175/226 |
| 4,573,539 | A | * | 3/1986 | Carroll et al. | 175/58 |
| 4,598,777 | A | | 7/1986 | Park et al. | |
| 4,631,677 | A | | 12/1986 | Park et al. | |
| 5,360,074 | A | | 11/1994 | Collee et al. | |
| 5,546,798 | A | | 8/1996 | Collee et al. | |
| 5,560,438 | A | | 10/1996 | Collee et al. | |
| 7,004,265 | B2 | | 2/2006 | Van Puymbroeck et al. | |
| 7,234,549 | B2 | * | 6/2007 | McDonough et al. | 175/378 |
| 2002/0129937 | A1 | * | 9/2002 | Cravatte | 166/264 |
| 2011/0299942 | A1 | * | 12/2011 | Schild et al. | 405/302.7 |

FOREIGN PATENT DOCUMENTS

| | | |
|---|---|---|
| GB | 842302 | 7/1960 |
| GB | 2143562 | 2/1985 |

OTHER PUBLICATIONS

Search Report and Written Opinion dated Jul. 30, 2013 for corresponding International Application No. PCT/US2012/038816 (11 pgs.).

* cited by examiner

*Primary Examiner* — Robert E Fuller
(74) *Attorney, Agent, or Firm* — Derek V. Forinash; Porter Hedges, LLP

(57) ABSTRACT

A coring apparatus comprises a coring bit operable to cut a core. An outer barrel is coupled to and configured to rotate the coring bit. An inner barrel is disposed within the outer barrel and is isolated from rotation with the outer barrel. A fabric sleeve is disposed within the inner barrel and configured to receive the core cut by the coring bit.

23 Claims, 2 Drawing Sheets

METHODS AND APPARATUS FOR CORING

CROSS-REFERENCE TO RELATED APPLICATIONS

This application claims priority to U.S. Patent Application Ser. No. 61/542,384, which was filed Oct. 3, 2011. This priority application is hereby incorporated by reference in its entirety into the present application, to the extent that it is not inconsistent with the present application.

BACKGROUND

This disclosure relates generally to methods and apparatus for acquiring and analyzing cores from subterranean formations. More particularly, this disclosure relates to methods and apparatus for utilizing an absorbent core barrel assembly to retain fluids that are ejected from a core and methods of analyzing the core and retained fluids.

Formation coring is a well-known process for obtaining a sample of a subterranean formation for analysis. In conventional coring operations, a specialized drilling assembly is used to obtain a cylindrical sample of material, or "core," from the formation and retain that core within a core barrel so that the core can be brought to the surface. Once at the surface, the core can be analyzed to reveal formation data such as permeability, porosity, and other formation properties that provide information as to the type of formation being drilled and/or the types of fluids contained within the formation.

In many hydrocarbon-bearing formations, the hydrocarbons are entrained within the formation at high pressures. As a core is being retrieved to the surface, the pressure acting on the core can be reduced and gas entrained in the core can expand and migrate out of the core. The expanding gases can also push formation fluids out of the core. In conventional coring operations, the formation fluids and gases are often lost as the core is retrieved to the surface, thus limiting the analysis that can be performed.

One method used to counteract the loss of formation fluids is "sponge coring." Sponge coring is similar to conventional coring but the coring assembly includes a core barrel that has an annular sponge that surrounds the core as it is acquired. The annular sponge can absorb formation fluid that is expelled from the core and can hold the fluid as the sample is retrieved to the surface. At the surface, the absorbed fluids can be analyzed to provide additional information about formation properties or formation fluids.

In conventional sponge coring tools, the sponge material is molded directly into a core barrel, or into a liner that fits into the core barrel. In many applications, an annular mold is formed by placing a cylindrical mandrel, which has a diameter substantially equal to the core to be acquired, inside a cylindrical liner. A liquid material (such as polyurethane), catalyst, and foaming agent are deposited into the mold and react to form a sponge material that fills the mold and hardens. During the molding process, the sponge material adheres to the liner or barrel and forms a non-adhering "skin" on the surface that contacts the mandrel. The mandrel is removed to leave an annular sponge adhered to the liner and having a circular hole through its center having the same diameter as the mandrel. The presence of the skin on the inner surface of the annular sponge limits absorption of fluid into the sponge and therefore requires a separate machining process to remove the skin and provide the necessary internal diameter to accept the core. Consistently and reliably machining the sponge material to the necessary diameter has proven to be a difficult process.

Conventional sponge coring tools are also susceptible to damage as the core moves through the annular sponge. In order to properly capture the formation fluid, the annular sponge is machined to an inner diameter that is closely matched to, or even in an interference fit with, the core that is being drilled. As the core moves relative to the annular sponge, the close engagement between the annular sponge and the core can result in the sponge being damaged. Once the sponge is damaged, it can interfere with the acquisition of the core or may lose the ability to effectively absorb fluids from the core and may therefore compromise the analysis sought to be performed. Attempts have been made to reinforce the annular sponge through strengthening members molded into the sponge material or by incorporating a non-absorbent retention mesh into the sponge material, but instances of damage to the annular sponge still occur.

The materials and methods used to form conventional sponge coring tools can also create limitations in the use of the technology. For example, the material used to form the annular sponge, often polyurethane foam, can interfere with some analysis, such as determining oil fluorescence using ultraviolet light. Further, conventional annular sponge material also tends to have a non-homogenous cross-section where permeability and absorbability of the material changes through the thickness of the material.

Thus, there is a continuing need in the art for methods and apparatus for acquiring and analyzing cores that overcome these and other limitations of the prior art.

BRIEF SUMMARY OF THE DISCLOSURE

In one embodiment, a coring apparatus can comprise an outer barrel coupled to and configured to rotate a coring bit. An inner barrel is disposed within the outer barrel and is isolated from rotation with the outer barrel. A fabric sleeve is disposed within the inner barrel and configured to receive the core that is cut by the core bit.

In another embodiment, a method of manufacturing a coring apparatus comprises coupling a coring bit to an outer barrel and disposing an inner barrel assembly within the outer barrel. The inner barrel assembly comprises a fabric sleeve operable to receive a core cut by the coring bit.

In another embodiment, a coring apparatus comprises an inner barrel with a fabric sleeve disposed within the inner barrel. A coring bit disposed proximate to one end of the inner barrel. The coring bit is operable to drill a core having an outer diameter substantially equal to an inner diameter of the fabric sleeve.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
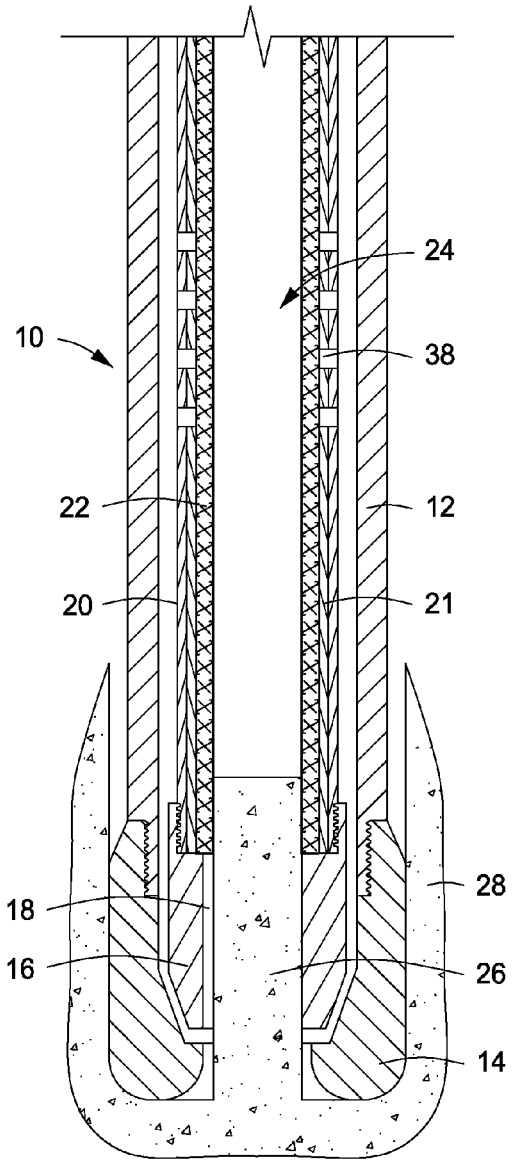
FIG. 1 is an partial-sectional schematic view of an exemplary coring assembly including a fabric sleeve.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, an exemplary coring apparatus 10 includes an outer barrel 12, a coring bit 14, a core catcher bowl 16, a core catcher 18, an inner barrel 20, and a barrel liner assembly 24. The coring bit 14 can be any suitable coring drill bit, such as a diamond bit, and is coupled to the outer barrel 12 so that rotation of the outer barrel rotates the coring bit. In operation, the outer barrel 12 can be coupled to a drill string or a drilling motor (not shown) that rotates the outer barrel 12. The inner barrel 20 is disposed within the outer barrel 12 but does not rotate with the outer barrel 12. The inner barrel 20 can be coupled to the core catcher bowl 16, which is at least partially disposed within coring bit 14. The core catcher 18 can be at least partially disposed within the core catcher bowl 16 and can provide a transition from the inner diameter of coring bit 14 to the barrel liner assembly 24.

The inner barrel 20 houses a barrel liner assembly 24 that fits closely within the inner barrel 20. The barrel liner assembly 24 can include a liner body 21 and a fabric sleeve 22 that has an inner diameter substantially equal to the diameter of the core drilled by coring bit 14. The liner body 21 and inner barrel 20 can include orifices 38 that provide a flow path from the inside of the barrel liner assembly 24 to the annulus between the liner body 21 and the inner barrel 20. Liner body 21 can be a tubular body manufactured from steel, aluminum, plastic, or any suitable material. It is also understood that fabric sleeve 22 can be coupled directly to barrel liner assembly 24 and the liner body 21 can be omitted from the assembly as desired.

For the purposes of this description, a fabric sleeve can be any sleeve formed from a material formed from fibers by weaving, knitting, felting, or any other method used to assemble fibers into a substantially homogeneous material. In certain embodiments, fabric sleeve 22 can be formed from a non-woven fabric material such as a felt, needle felt, scrim-supported needle felt, or other non-woven fabric material manufactured from fibers having high tenacity and a long staple. Exemplary non-woven fabric sleeves are manufactured by Andrew Webron Ltd. for use in filtration applications. Fabric sleeve 22 can be a seamless cylinder or may have one or more longitudinal seams that can facilitate removal of the sleeve from the core for analysis. The fabric sleeve 22 can be a singular elongated cylinder or can be manufactured from a plurality of shorter length cylinders connected in series.

The fabric sleeve 22 can be manufactured from any material that will satisfactorily interact with the expected wellbore fluids. The thickness, density, and permeability of the material can be selected based on the expected wellbore conditions and the configuration of the coring apparatus. For example, a fabric sleeve 22 can be manufactured from a fabric between 0.0625 and 0.75 inches thick, having a density of between 1 lbs./cu.ft. and 10 lbs./cu.ft., and having a permeability of between 0.1 and 10 millidarcys. The fabric used can be an oil-wetting material, a water-wetting material, a non-absorbing material, or a combination thereof, including, but not limited to polypropylene, polyester, polyaramid, homopolymer acrylic, and polyphenylsulphide. Other properties of the fabric material, such as color, can be selected based on the formation fluids expected and the intended analysis. For example, a low ultraviolet reflective fabric can be used in applications where oil fluorescence will be measured using ultraviolet light.

The composition of the fabric sleeve 22 can provide resistance to tearing, shearing, and other damage often seen in conventional sponge coring applications. For example, a fabric sleeve 22 manufactured from high-tenacity, long staple fibers assembled into a non-woven felt can provide increased resistance to tearing compared to a polyurethane foam sponge. Damage that may occur in the fabric sleeve 22 will likely be localized, therefore reducing the likelihood for damage to the fabric sleeve 22 to impact acquisition of the core 26.

Further, the fabric sleeve 22 can be manufactured with a closely controlled inner diameter and thickness that can eliminate the need for any finish machining of the barrel liner assembly 24. The fabric sleeve 22 can be manufactured so as to have substantially consistent properties across its thickness. As previously discussed, polyurethane foam used in conventional sponge coring has a variable permeability and density across its thickness that may interfere with the absorption of formation fluids. Due to its substantially homogenous nature, a fabric sleeve 22 can have consistent properties across its thickness, which can enable reliable absorption of formation fluids and an increased resistance to tearing or other damage.

Figure 2:
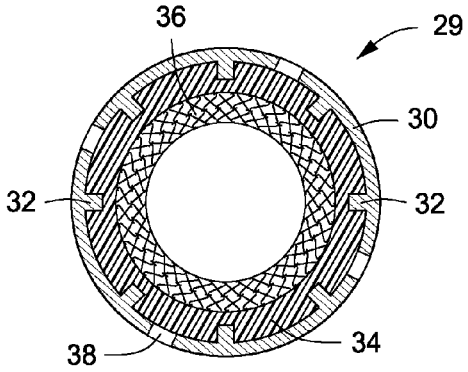
FIG. 2 is a partial sectional view of an exemplary inner barrel liner assembly including a fabric sleeve and an annular sponge with internal supports extending inward from the barrel liner.

Referring now to FIG. 2, a cross-sectional view of an exemplary barrel liner assembly 29 is shown including a liner body 30, retention members 32, a molded layer 34, and a fabric sleeve 36. Retention members 32 protrude inward from the wall of liner body 30 and can be integrally formed as part of the liner body or attached to the liner body through other means. Retention members 32 can be longitudinal, spiral, helical, or in any desired configuration. The liner body 30 can also include a plurality of orifices 38 that extend through the liner body 30 and are operable to relieve pressure and vent gas from the interior of the liner body 30.

Molded layer 34 can be coupled to the interior walls of liner body 30 and to retention members 32. The molded layer 34 can be a layer of material that is molded onto liner body 30. The molded layer 34 can be a formed from a polymer, such as foamed or solid polyurethane, or other moldable material. The fabric sleeve 36 is coupled to the molded layer 34 and has an inner diameter sized to be in close contact with a core that is received by the barrel liner assembly 29. The fabric sleeve 36 may be affixed to molded layer 34 by an adhesive or may be partially molded into the molded layer.

The molded layer 34 can be formed by directly molding the layer in place between the liner body 30 and the absorbent fabric sleeve 36. As previously described, the absorbent fabric sleeve 36 can be provided as a cylinder of material having a selected thickness and inner diameter. The fabric sleeve 36 can be centrally disposed in the liner body 30 and offset from the inner diameter of the liner body 30 to form an annular mold into which the molded layer 34 can be formed.

As the liquid material is poured into the mold, it engages the outer edge of the fabric sleeve 36 and permeates a short distance into the fabric sleeve 36. As the material sets to form the molded layer 34, the engagement with the fabric sleeve 36 affixes the molded layer 34 to the fabric sleeve. Manufacturing the barrel liner assembly 29 in this method eliminates the need for machining molded layer 34 after it is formed. Further, because absorbent fabric sleeve 36 can be manufactured to the desired finished diameter, once the molding process is complete, the barrel liner assembly 29 can be ready for use without any further processing.

Figure 3:
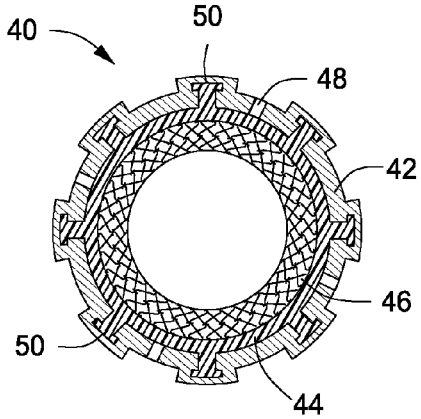
FIG. 3 is a partial sectional view of an exemplary inner barrel liner assembly including a fabric sleeve and an annular sponge with supports extending through the barrel liner.

Referring now to FIG. 3, an exemplary barrel liner assembly 40 includes a liner body 42, a molded layer 44, and a fabric sleeve 46. The liner body 42 can include a plurality of orifices 48, and a plurality of retention channels 50. Orifices 48 are operable to relieve pressure from the interior of the liner body 42.

Integral channels 50 are shown as T-shaped slots but can have any desirable shape, including, but not limited to, T-shaped, L-shaped, and diagonal slots. During the molding process, the liquid sponge material enters the channels 50. As the liquid material hardens to form the molded layer 44, the material fills the channels 50. Once molded layer 44 is formed, the retention channels 50 provide additional contact area between the liner body 42 and the molded layer 44. This additional contact area can help to support the molded layer 44 and aid in preventing the molded layer 44 from tearing away from the liner body 42.

The molded layer 44 can be formed by directly molding the molded layer 44 in place between the liner body 42 and the absorbent fabric sleeve 46. The fabric sleeve 46 can be centrally disposed in the liner body 42 and offset from the inner diameter of the liner body 42 to form an annular mold into which the molded layer 44 can be formed. As liquid material is poured into the mold, it can permeate a short distance into the fabric sleeve 46. As the material sets to form the molded layer 44, the fabric sleeve 46 is affixed to the molded layer 44. In other embodiments, the fabric sleeve 46 can be affixed to the molded layer 44 by an adhesive.

Figure 4:
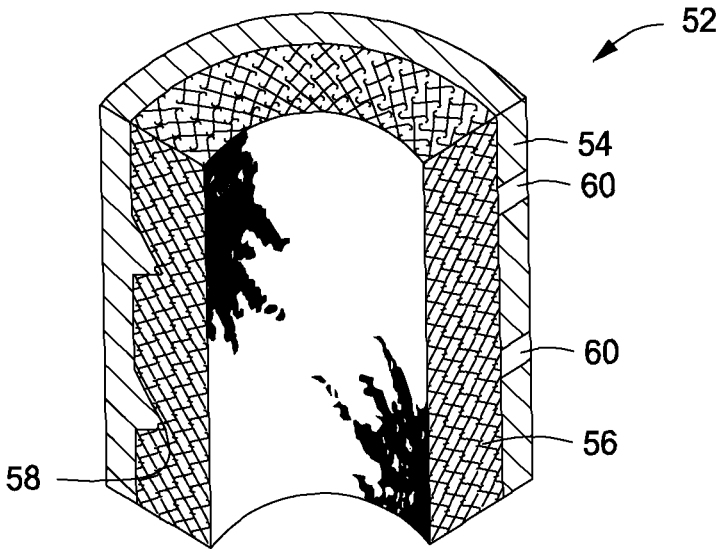
FIG. 4 is a partial sectional isometric view of an exemplary inner barrel liner assembly including a fabric sleeve mechanically coupled to the liner.

Referring now to FIG. 4, an exemplary barrel liner assembly 52 includes liner body 54 and fabric sleeve 56. Fabric sleeve 56 can be affixed directly to liner body 54 through the use of an adhesive, mechanical means, or a combination thereof. The liner body 54 can include retention members 58 that act to engage fabric sleeve 56 and retain the layer in the liner body. The retention members 58 can be integrally formed as part of the liner body 54, may be coupled onto the liner body 54, or can be inserted through the wall of the liner body 54.

The retention members 58 may be shaped to allow the fabric sleeve 56 to move longitudinally relative to the liner body 54 in a first direction but prevent the fabric sleeve from moving longitudinally in the opposite direction. In this manner, the retention members 58 allow the fabric sleeve 56 to be inserted longitudinally into the liner body 54 but retain the fabric sleeve 56 in position during coring operations. Liner body 54 can also include orifices 60 that relieve pressure and vent gas from inside the liner body 54.

Figure 5:
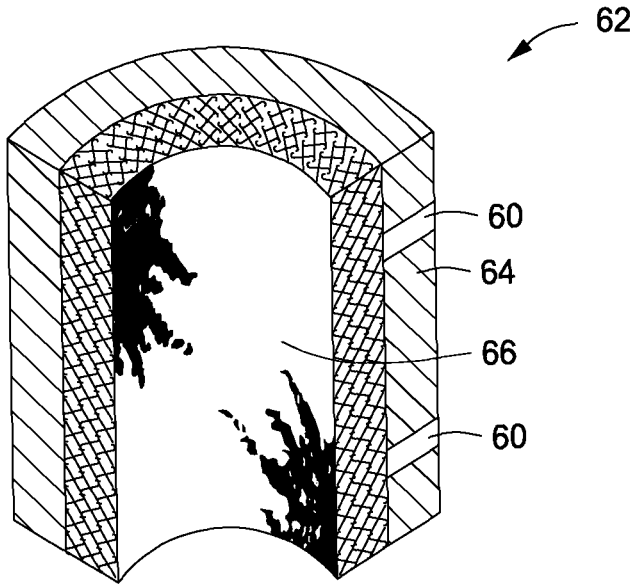
FIG. 5 is a partial sectional isometric view of an exemplary inner barrel liner assembly including an integral fabric sleeve.

Referring now to FIG. 5, an exemplary barrel liner assembly 62 includes a liner body 64 and a fabric sleeve 66. Liner body 64 can be constructed from a moldable material, such as polyurethane, that can be formed onto the fabric sleeve 66. The fabric sleeve 66 can be disposed within a cylindrical mold into which a liquid material is poured. As the material sets to form the liner body 64, it can permeate a short distance into the fabric sleeve 66, thus affixing the fabric sleeve 66 to the liner body 64. Liner body 64 can also include orifices 60 that relieve pressure and vent gas from inside the liner body 64.

Referring back to FIG. 1, to acquire a core for analysis, the coring apparatus 10 is run into a wellbore disposed in formation 28. As it is run into the formation 28, the coring apparatus 10 can be subjected to increasing hydrostatic pressure. If the fabric sleeve 22 contains interstitial volumes that are filled with air, or any other compressible fluid, the increasing hydrostatic pressure can compress and potentially damage the fabric sleeve 22. In order to counteract the compressive forces created by the increasing pressure, the barrel liner assembly 24 and fabric sleeve 22 can be filled with a pressurized fluid, or "pre-load fluid," before being run into the formation 28.

The pre-load fluid is selected so that the fluid is not absorbed by the fabric sleeve 22. For example, if the fabric sleeve 22 is made from an oil-absorbing material, water could be used as a pre-load fluid. The selected pre-load fluid is not absorbed by the fabric sleeve 22 but can fill any interstitial areas within the fabric sleeve 22, preventing damage to the fabric sleeve 22 as it is subjected to increasing hydrostatic pressure from being run into the formation 28.

Once the coring apparatus 10 reaches the bottom of the wellbore in the formation 28, the outer barrel 12 and coring bit 14 are rotated. Rotation of the coring bit 14 deepens the wellbore in formation 28 and creates core 26, which increases in length as the coring bit 14 is moved through the formation 28. As the core 26 moves through the center opening of the coring bit 14, it is guided by core catcher 18 into barrel liner assembly 24.

As the core 26 moves into the barrel liner assembly 24, the fabric sleeve 22 closely engages the outer surface of the core 26. As coring bit 14 continues drilling, the core 26 moves further into engagement with the fabric sleeve 22. As the core 26 moves relative to the fabric sleeve 22, it slides along the surface of the fabric sleeve 22. As previously discussed, the fabric sleeve 22 resists tearing and damage caused by the dynamic interface with the core 26 and can reduce the impact of any damage by maintaining the damage in a localized area. Once drilling is complete, the core 26 can be disconnected from the formation 28. The core 26 is retained within fabric sleeve 22 and barrel liner assembly 24 and the coring apparatus 10 can be withdrawn from the formation 28.

As the core 26 is withdrawn from the formation, the hydrostatic pressure acting on the core 26 decreases. This decreasing pressure allows gas entrained within core 26 to expand in volume. As the gas expands, gas and other formation fluids contained within the core 26 can migrate out of the core 26. Any fluids that migrate out of the core 26 will flow into fabric sleeve 22. The close contact between the core 26 and the fabric sleeve 22 prevents gravity separation of fluids that migrate out of the core and maintains the formation fluids in close proximity to the portion of the core 26 from which they originated.

As migrating gases and formation fluids flow into the fabric sleeve 22, pre-load fluid entrained in the fabric sleeve 22 will be displaced. The displaced pre-load fluid can pass laterally outward through orifices 38. Fabric sleeve 22 is operable to absorb one or more of the formation fluids that can migrate out of the core 26. For example, if the fabric sleeve 22 is oil-wetting, it can absorb hydrocarbons that migrate out of the core 26 while allowing water that migrates out of the core 26 to pass through without being absorbed. Because absorbent fabric sleeve 22 has a high permeability that is relatively constant across its thickness, non-absorbed fluids and gases can easily pass laterally through the fabric sleeve 22 and the orifices 38.

This lateral movement of the fluids and gases through the fabric sleeve 22 and the orifices 38 can prevent a backpressure from forming therein that can impede free transfer of formation fluids present in the core 26 into the sleeve 22. In addition, gases migrating out from the formation 28 can expand in volume so the orifices 38 provide an important pressure relief function.

After the core 26 and fabric sleeve 22 are withdrawn from the well, they can be shipped to a laboratory for analysis. As will be discussed in detail to follow, fluids retained by the fabric sleeve 22 can be analyzed along with the core 26 to provide useful information about the formation 28 and any fluids entrained in the formation.

In one example, the core 26 can be analyzed to establish the presence of hydrocarbon liquids, determine the amount of hydrocarbon liquids that can be held by the formation, and provide a qualitative assessment of any hydrocarbon liquids found. To facilitate this analysis, fabric sleeve 22 can be manufactured from an oil-wetting material that will preferentially absorb hydrocarbon liquids but will not absorb water. Once the core 26 is recovered, the core and the barrel liner assembly 24 can be sectioned along a longitudinal plane. The core 26 and fabric sleeve 22 can be analyzed to determine which portions of the core 26 produced hydrocarbon fluids during coring and which portions still contain entrained hydrocarbon fluids.

The hydrocarbon liquids found in the core 26 and/or in the fabric sleeve 22 can also be analyzed to determine what type and quality of hydrocarbons are found in the formation. One method for qualitatively assessing the liquid hydrocarbons is determining the fluorescence of the liquids using ultraviolet light. In this analysis, the fabric sleeve 22 can be examined with an ultraviolet light in order to determine the fluorescence of any oil contained within the sleeve 22. Certain reflective materials may interfere with this analysis so the fabric sleeve 22 can be manufactured from a material that minimizes reflection of ultraviolet light so as to reduce interference with the determination of fluorescence of the liquid.

The hydrocarbon liquids that are collected by the fabric sleeve 22 and the hydrocarbon liquids that remain in the formation can be analyzed to determine the oil saturation of the formation, which can be used to determine the amount of oil that may be in place in the formation. In order to facilitate analysis, formation fluids can be recovered from fabric sleeve 22 by one or more processes including, but not limited to, mechanical separation, chemical treatments, thermal processing, or any combination thereof.

The analysis of the core and fabric sleeve 22 can include a solvent extraction method to remove all the hydrocarbons from the fabric sleeve 22. Conventional solvents, such as toluene, used to extract hydrocarbons from foam, which often caused a reaction with the foam itself, will not typically react with the fabric sleeve 22. After the hydrocarbons have been extracted from the fabric sleeve 22 and are in solution with the solvent, usual means of measuring the oil content in the solution can be used, e.g. florescence intensity, or gas chromatography. The oil saturation measured in the fabric sleeve can then be added to the oil saturation measured in the core, to provide a more accurate determination of the volume of oil in the core, and by application the amount of oil in the reservoir.

In another example, a core 26 is recovered from a formation that contains hydrocarbon gases and water, but does not contain significant amounts of hydrocarbon liquids. An indication as to the amount of gas entrained in the formation can be determined if the amount of water in the formation, or water saturation, can be determined. In order to facilitate this analysis, fabric sleeve 22 can be manufactured from a water-wetting material that will preferentially absorb water but will not absorb hydrocarbon liquids.

As the core 26 is recovered from the formation, gases entrained in the formation will expand and migrate out of the core. As the gases migrate, they can cause water and other formation fluids to also migrate out of the core. As these fluids migrate, fabric sleeve 22 will absorb water while allowing any hydrocarbon fluids to pass through the sleeve. The water absorbed by the fabric sleeve 22 can be recovered and, along with water retained in the core 26, analyzed to determine the water saturation of the formation.

The fabric sleeve 22 may also act as a jam prevention tool. A core jam normally occurs when a core that enters a conventional coring assembly fractures and the broken core wedges across the confining inner diameter of an inner barrel. When a core jam occurs, the core can no longer enter the core barrel and, once the problem is detected, the core run is ended. The coring assembly is pulled from the well and additional core runs may be needed to recover the total zone of interest. A core jam can also subject the core below the point of jam to high compressive forces as drill string weight is transferred to the core column. This compressive force can eventually exceed the strength of the core column and result in a broken and damaged core, which significantly reduces its value in core analysis. If the formation is soft and friable, the jam may not be identified by surface operating parameters and the jammed barrel may mill up, or drill additional hole without core entry, thus losing valuable data.

The fabric sleeve 22 can act to guide to allow the core to continue moving into the core barrel even though the core may have fractures that would normally try to wedge against the inner diameter of a conventional inner tube and jam. Conventional sponge liners often tear or delaminate when interacting with a fractured core. The high tenacity, shear strength, and flexibility of a fabric sleeve could contain or channel the core as it passes into the inner barrel. The fabric sleeve 22 can allow some diametrical expansion of the core column and act as a guide by not allowing it to get a firm purchase on the surface of the fabric.

To further enhance resistance to a core jam, a fabric sleeve 22 could be saturated with a lubricant, such as mineral oil, to provide lubricity in addition to the guiding of the core. Once the fabric sleeve 22 is saturated with a lubricant, the excess lubricant can be drained from the liner assembly, but the lubricant saturated in the fabric sleeve 22 will be retained.

Conventional systems used to mitigate core jams often have relatively short lengths over which the system can be effective. Because the fabric sleeve 22 covers the inner surface of the liner assembly, running multiple lengths of liner together can allow jam protection over a much longer length, perhaps 300 ft, or more.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A coring apparatus comprising:

a coring bit operable to cut a core;

an outer barrel coupled to and configured to rotate the coring bit;

an inner barrel disposed within the outer barrel and being isolated from rotation with the outer barrel; and a barrel liner assembly disposed within and axially stationary relative to the inner barrel, wherein the barrel liner assembly includes a molded layer and a cylindrical fabric sleeve affixed to the molded layer and configured to receive the core cut by the coring bit, wherein the fabric sleeve is formed from an absorbent material.

2. The coring apparatus of claim 1, wherein the fabric sleeve comprises a non-woven fabric.

3. The coring apparatus of claim 1, wherein the fabric sleeve comprises a felt.

4. The coring apparatus of claim 1, wherein the fabric sleeve is molded into the molded layer.

5. The coring apparatus of claim 1, wherein the fabric sleeve is affixed to the molded layer by an adhesive.

6. The coring apparatus of claim 1, further comprising a retention member extending inward from the inner barrel toward the fabric sleeve.

7. The coring apparatus of claim 1, wherein the fabric sleeve is formed from a material that will not absorb water but will absorb hydrocarbons.

8. The coring apparatus of claim 1, wherein the fabric sleeve is formed from a material that will absorb water but will not absorb hydrocarbons.

9. A method of manufacturing a coring apparatus comprising:

coupling a coring bit to an outer barrel; and disposing an inner barrel assembly within and axially stationary relative to the outer barrel, wherein the inner barrel assembly comprises a molded layer and a cylindrical fabric sleeve affixed to the molded layer and is operable to receive a core cut by the coring bit, wherein the fabric sleeve is formed from an absorbing material.

10. The method of claim 9, wherein the fabric sleeve comprises a non-woven fabric.

11. The method of claim 9, wherein the fabric sleeve comprises a felt.

12. The method of claim 9, wherein the fabric sleeve is molded into the molded layer.

13. The method of claim 9, wherein the fabric sleeve is affixed to the molded layer by an adhesive.

14. The method of claim 9, wherein the inner barrel assembly further comprises a retention member coupled to the inner barrel and to the fabric sleeve.

15. The method of claim 9, wherein the fabric sleeve is formed from a material that will not absorb water but will absorb hydrocarbons.

16. The method of claim 9, wherein the fabric sleeve is formed from a material that will absorb water but will not absorb hydrocarbons.

17. A coring apparatus comprising:

an inner barrel;

a barrel liner assembly disposed within and axially stationary relative to the inner barrel, wherein the barrel liner assembly includes a molded layer and a cylindrical fabric sleeve affixed to the molded layer, wherein the fabric sleeve has an inner diameter, and wherein the fabric sleeve is formed from an absorbent material; and a coring bit disposed proximate to one end of the inner barrel, wherein the coring bit is operable to drill a core having an outer diameter substantially equal to the inner diameter of the fabric sleeve.

18. The coring apparatus of claim 17, wherein the fabric sleeve comprises a non-woven fabric.

19. The coring apparatus of claim 17, wherein the fabric sleeve comprises a felt.

20. The coring apparatus of claim 17, wherein the fabric sleeve is molded into the molded layer.

21. The coring apparatus of claim 17, further comprising a retention member coupled to the inner barrel and to the fabric sleeve.

22. The coring apparatus of claim 17, wherein the fabric sleeve is formed from a material that will not absorb water but will absorb hydrocarbons.

23. The coring apparatus of claim 17, wherein the fabric sleeve is formed from a material that will absorb water but will not absorb hydrocarbons.

* * * * *